US007185489B2

(12) United States Patent
Kolstad et al.

(10) Patent No.: US 7,185,489 B2
(45) Date of Patent: Mar. 6, 2007

(54) PARTICULATE TRAP

(75) Inventors: Owen Charles Kolstad, Peoria, IL (US); Kartik Ganesan Iyer, Dunlap, IL (US); Kerry Allen Delvecchio, Dunlap, IL (US); Joanna Louise Williams, Peoria, IL (US)

(73) Assignee: Caterpillar Inc, Peoria, IL (US)

( * ) Notice: Subject to any disclaimer, the term of this patent is extended or adjusted under 35 U.S.C. 154(b) by 140 days.

(21) Appl. No.: 10/743,753

(22) Filed: Dec. 24, 2003

(65) Prior Publication Data

US 2005/0138920 A1 Jun. 30, 2005

(51) Int. Cl.
*F01N 3/00* (2006.01)

(52) U.S. Cl. ..... 60/297; 60/288; 60/292; 60/295; 60/311; 55/DIG. 30; 55/283; 55/385.3; 137/599.1; 137/625.31; 251/61.2; 251/63.6; 95/278; 95/283

(58) Field of Classification Search ..... 137/115.13, 137/599, 625.31, 599.01; 251/61.2, 63, 63.6, 251/249.5, 318; 95/278, 283; 60/288, 291, 60/292, 295, 297, 311, 324; 55/DIG. 30, 55/213, 217, 283, 341.2, 385.3, 523
See application file for complete search history.

(56) References Cited

U.S. PATENT DOCUMENTS 5,293,742 A * 3/1994 Gillingham et al. ..... 60/288
5,357,755 A * 10/1994 Gillingham et al. ..... 60/288
5,454,845 A * 10/1995 Anahara et al. ..... 55/482.1
6,090,172 A 7/2000 Dementhon et al.
6,120,583 A * 9/2000 Saito et al. ..... 95/278
6,233,926 B1 * 5/2001 Bailey et al. ..... 60/295
6,447,564 B1 * 9/2002 Ohno et al. ..... 55/282.3
6,572,682 B2 6/2003 Peter et al.

FOREIGN PATENT DOCUMENTS

WO WO 01/14696 A1 3/2001
WO WO 02/063145 A2 8/2002
WO WO 02/083268 A1 10/2002
WO WO 03/002854 A1 1/2003

* cited by examiner

*Primary Examiner*—Binh Q. Tran
(74) *Attorney, Agent, or Firm*—Finnegan, Henderson, Farabow, Garrett & Dunner

(57) ABSTRACT

A particulate trap has a housing and a plurality of filters disposed within the housing. The particulate trap also has a plurality of dividers fluidly isolating one or more of the plurality of filters into filter divisions. The particulate trap has at least one inlet and at least one outlet individually associated with each filter division, and a valve assembly configured to selectively block a flow of exhaust air through each of the inlets.

29 Claims, 2 Drawing Sheets

PARTICULATE TRAP

TECHNICAL FIELD

The present disclosure relates generally to a particulate trap, and more particularly to a particulate trap having regeneration capabilities.

BACKGROUND

Engines, including diesel engines, gasoline engines, natural gas engines, and other engines known in the art, may exhaust a complex mixture of air pollutants. The air pollutants may be composed of gaseous and solid material, which include particulate matter. Particulate matter may include unburned carbon particles, which are also called soot.

Due to increased attention on the environment, exhaust emission standards have become more stringent. The amount of particulates emitted from an engine may be regulated depending on the type of engine, size of engine, and/or class of engine. One method that has been implemented by engine manufacturers to comply with the regulation of particulate matter exhausted to the environment has been to remove the particulate matter from the exhaust flow of an engine with a device called a particulate trap. A particulate trap is a filter designed to trap particulate matter and consists of a wire mesh medium. However, the use of the particulate trap for extended periods of time may cause the particulate matter to build up in the wire mesh, thereby causing the functionality of the filter and engine performance to decrease.

One method of improving the performance of the particulate trap may be to implement regeneration. For example, U.S. Pat. No. 6,572,682 (the '682 patent) issued to Peter et al., on Jun. 3, 2003, describes using a self-cleaning filter system to remove particulate matter from an exhaust flow of an engine. The filter system of the '682 patent is designed for use in a diesel engine and comprises a filter media stack having a plurality of sub-cartridges. Exhaust flow is directed through each of the sub-cartridges via damper valves, to remove particulate matter from the exhaust flow. A heater is used to increase the temperature of the filter and the trapped particulate matter above the combustion temperature of the particulate matter, thereby burning away the collected particulate matter and regenerating the filter system.

Although the filter system of the '682 patent may reduce the particulate matter exhausted to the environment, and reduce the buildup of particulate matter in the filter system, the filter system may nonetheless be problematic. By means of example, the filter media stack of the '682 patent may not be fluidly isolated from the exhaust flows of the other filter media stacks within the same particulate trap. As a result, the exhaust flowing through non-regenerating filter media stacks may cause the regenerating filter media stack to require additional power to regenerate. In addition, the filter system of the '682 patent may not conform to a variety of packing environments.

The present disclosure is directed to overcoming one or more of the problems set forth above.

SUMMARY OF THE INVENTION

In one aspect, the present disclosure is directed to a particulate trap that includes a housing and a plurality of filters disposed within the housing. The particulate trap also includes a plurality of dividers fluidly isolating one or more of the plurality of filters into filter divisions. The particulate trap further includes at least one inlet and at least one outlet individually associated with each filter division, and a valve assembly configured to selectively block a flow of exhaust air through each of the inlets In another aspect, the present disclosure is directed to a method of removing particulates from an exhaust flow. The method includes flowing exhaust through a plurality of inlets. Each of the inlets direct a portion of the exhaust flow to an associated filter division, each filter division being fluidly isolated from at least one other filter division and having at least one filter. The method also includes filtering particulates out of the exhaust flow with the at least one filter. The method further includes selectively blocking the exhaust flow through at least one filter division, and selectively applying electrical current to at least one filter section of the at least one filter.

DETAILED DESCRIPTION

Figure 1:
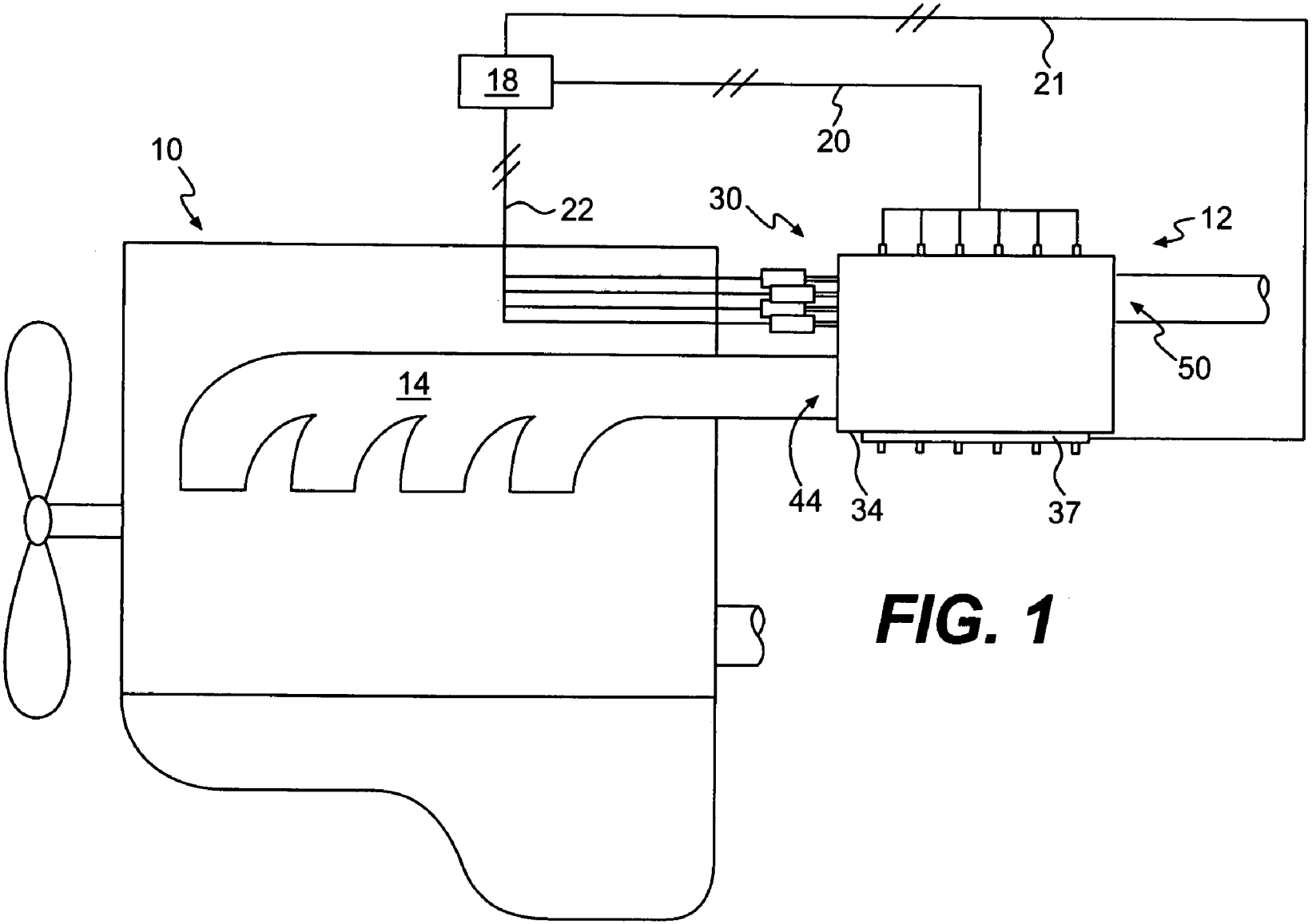
FIG. 1 is a diagrammatic illustration of an engine having an exemplary embodiment of a particulate trap.

FIG. 1 illustrates an engine 10 having an exemplary embodiment of a particulate trap 12. Engine 10 may include an exhaust manifold 14 connecting an exhaust flow of engine 10 with particulate trap 12. A controller 18 may be in communication with particulate trap 12 via communication lines 20, 21, and 22.

Figure 2:
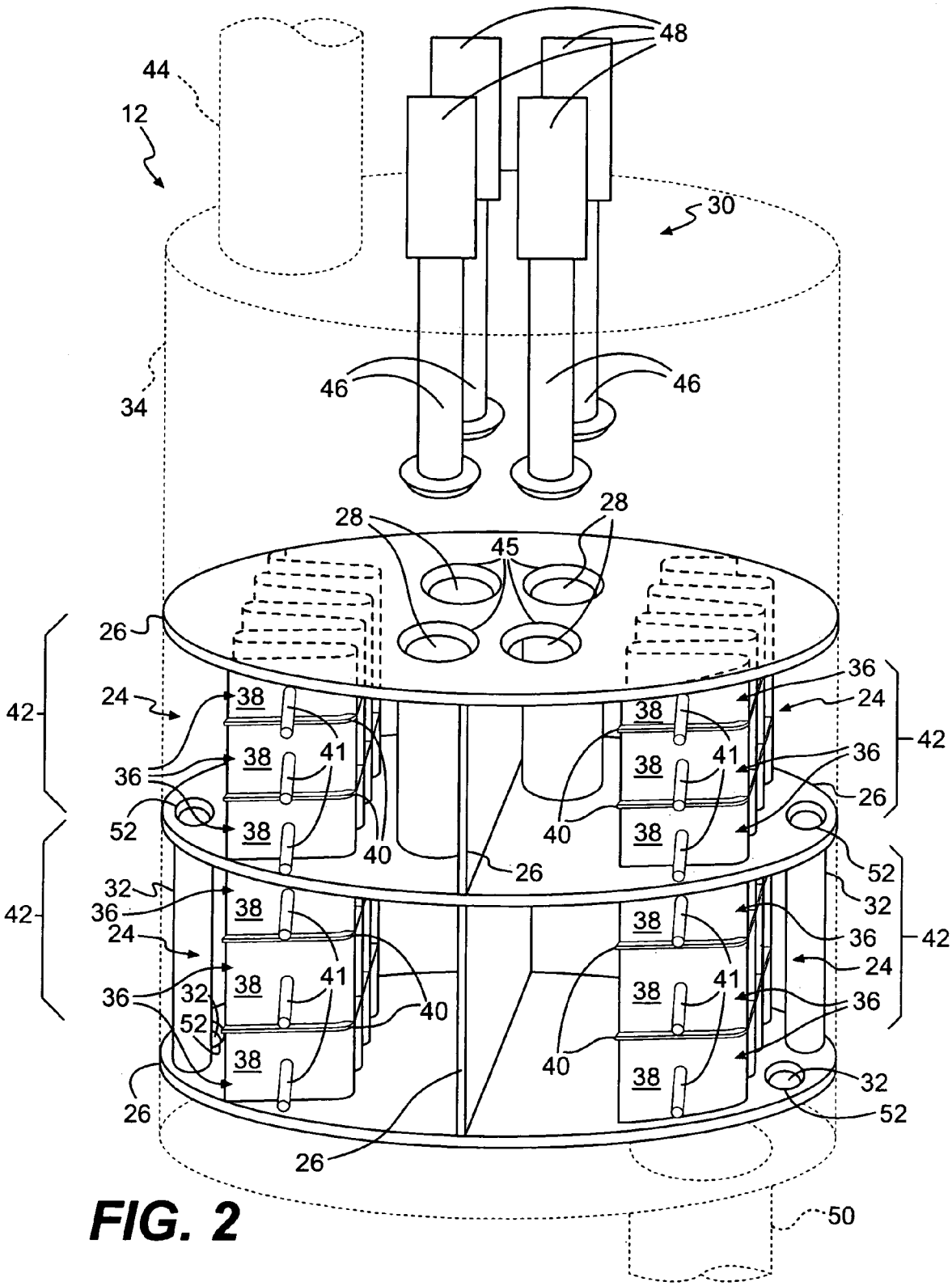
FIG. 2 is a perspective diagrammatic view of an exemplary embodiment of a particulate trap.

As illustrated in FIG. 2, particulate trap 12 may include multiple filters 24, one or more insulating dividers 26, a plurality of inlets 28, a valve assembly 30, a plurality of outlets 32, and a housing 34.

Each of filters 24 may be substantially rectangular in shape and configured to allow exhaust to flow from a first side to a second side. Each of filters 24 may include one or more filter sections 36, each having a corrugated wire-mesh media 38 that are electrically conductive and separated from each other by insulating members 40. Alternately, each of filter sections 36 may include ceramic media having electrically conductive fibers, or any other means known in the art for filtering particulates from an exhaust flow. Each of filter sections 36 may be stacked in layers, as shown in FIG. 2. Alternately, filter sections 36 may be arranged in rows and/or columns. Each of filter sections 36 may include at least two electrical connectors 41 (only one shown in FIG. 2 for each filter section 36), one connected to each end of each filter section 36. Electrical connectors 41 may connect one or more filter sections 36 to a power source (not shown) to form an electrical circuit. The filter sections 36 may be electrically connected on at least one end via a common bus bar 37 (FIG. 1).

One or more of insulating dividers 26 may separate one or more of filters 24 to create one or more filter divisions 42 within particulate trap 12. It is contemplated that additional or fewer filter divisions 42 than what are illustrated could be included in particulate trap 12.

Particulate trap 12 may include a number of inlets 28 equal to the number of filter divisions 42. The inlets 28 may include openings through the filter divisions 42 and tubes that extend from the common inlet to filter divisions 42 that are spaced a distance from the common inlet. Each of inlets 28 may direct exhaust flow from a common inlet 44 to one of filter divisions 42. Each of inlets 28 may include a flared entry portion 45 in fluid communication with the common inlet to reduce an inlet restriction of the exhaust flow. As illustrated in FIG. 2, the tubes associated with inlets 28 may have different lengths depending on the distance an associated filter division 42 is from common inlet 44. For example, a tube associated with a lower filter division 42 will be longer than the tube associated with an upper filter division 42, and will extend through the upper filter division 42.

Valve assembly 30 may include a plurality of valve elements 46, the number of valve elements 46 being equal to the number of inlets 28. Each valve element 46 may be configured to block or substantially restrict exhaust flow through an associated inlet 28. Valve assembly 30 may include valve actuators 48 configured to cause each of valve elements 46 to selectively move in and out of a blocking position relative to inlets 28. Valve actuators 48 may include a solenoid actuator, a hydraulic actuator, a piezo actuator, or any other actuator known in the art.

Particulate trap 12 may include a number of outlets 32 equal to the number of filter divisions 42. The outlets 32 may include openings through the filter divisions 42 and tubes that extend from filter divisions 42 to a common outlet 50. Each of outlets 32 may direct filtered exhaust flow from an associated filter division 42 to the common outlet 50. Each of outlets 32 may include a flared entry portion 52 in fluid communication with the associated filter divisions 42. As illustrated in FIG. 2, the tubes associated with outlets 32 may be different lengths depending on the distance an associated filter division 42 is from the common outlet 50. For example, the tube associated with an upper filter division 42 will be longer than a tube associated with a lower filter division 42 and will extend through the lower filter division 42.

Referring to FIG. 1, controller 18 may include all the components to operate particulate trap 12 such as, for example, a memory, a secondary storage device, and a processor. Various circuits may be associated with controller 18 such as, for example, power supply circuitry, signal conditioning circuitry, solenoid driver circuitry, and other appropriate circuitry. Controller 18 may also be in communication with one or more pressure sensors within particulate trap 12. A first pressure sensor (not shown) may be in fluid communication with inlet 44 and a second pressure sensor (not shown) may be in fluid communication with outlet 50 to aid in a measurement of a pressure differential across the filters 24 within the particulate trap 12.

INDUSTRIAL APPLICABILITY

The disclosed particulate trap 12 may be applicable to any combustion-type engine. Particulate trap 12 may allow for a less complex and lower cost alternative for reducing the amount of particulate matter exhausted to the environment. The operation of particulate trap 12 will now be explained in detail.

According to an exemplary embodiment of particulate trap 12, exhaust flow may be directed into particulate trap 12 through common inlet 44 and into inlet tubes 28. As illustrated in FIG. 2, the exhaust flow may be directed from inlets 28 to filter divisions 42.

As exhaust flows through filter divisions 42, particulate matter may be removed from the exhaust flow by the wire mesh media 38 of filter sections 36. Over time, the particulate matter may build up in wire mesh media 38. If unchecked, such particulate matter buildup could be significant enough to restrict, or even block the flow of exhaust through openings of wire mesh media 38, allowing for pressure within the exhaust system of engine 10 to increase. An increase in the back-pressure of engine 10 could reduce the engine's ability to draw in fresh air, resulting in decreased performance of engine 10, increased exhaust temperatures, and poor fuel consumption.

To prevent the undesired buildup of particulate matter within particulate trap 12, individual filter sections 36 within a particular filter division 42 may be regenerated. The filter sections 36 within a particular filter division 42, may be regenerated at the same time or individually at different times. Regeneration may be periodic or based on a predetermined triggering condition. The predetermined triggering condition may be a lapsed time of engine operation, a pressure differential measured across particulate trap 12, or any other triggering condition known in the art.

Controller 18 may be configured to cause regeneration of the filter divisions 42. When controller 18 determines that regeneration is required (e.g., when a lapse of time corresponding to engine operation is greater than a predetermined value, or when a pressure measured across particulate trap 12 is greater than a predetermined value), controller 18 may cause one of valve elements 46 to engage one of inlets 28 to block the flow of exhaust to one filter division 42. It is contemplated that the valve elements may be alternately engaged in a blocking position, or more than one valve element 46 may be engaged at a given time to block more than one filter division 42. It is also contemplated that one valve element may be configured to block more than one filter division 42 at a given time.

When the exhaust flow is blocked from one filter division 42, controller 18 may connect the power source via electrical connectors 41 to at least one filter section 36 of blocked filter division 42. Current from the power source (not shown) may cause filter section 36 to heat up above the combustion temperature of the particulate matter trapped in filter section 36, thereby burning away the buildup of particulate matter.

Blocking the exhaust flow from regenerating filter section 36 may reduce the energy required for regeneration, because the relatively cool flow of exhaust, when compared to the heat required for regeneration, may absorb heat during the regeneration process. Because each filter section 36 within each filter division 42 may be separately regenerated, the magnitude of power required at any one time for regeneration may be low. The low power required for regeneration may allow for low-cost, power-generating and power circuit components. In addition, because each filter division undergoing regeneration is fluidly isolated from the other filter divisions within the same particulate trap, the exhaust flowing through non-regenerating filter divisions does not affect the amount of energy required to regenerate the fluidly isolated filter division.

After filtration of the particulate matter, the filtered exhaust may exit filter division 42. The filtered exhaust may be directed out of particulate trap 12 via outlets 32 and common outlet 50.

It will be apparent to those skilled in the art that various modifications and variations can be made to the disclosed particulate trap without departing from the scope of the present disclosure. Other embodiments of the disclosed particulate trap will be apparent to those skilled in the art from consideration of the specification and practice of the particulate trap disclosed herein. It is intended that the specification and examples be considered as exemplary only, with a true scope of the disclosure being indicated by the following claims and their equivalents.

What is claimed is:

1. A particulate trap, comprising:

a housing;

a plurality of filters disposed within the housing, wherein each of the plurality of filters includes a plurality of filter sections separated from an adjacent filter section by an insulating member, wherein each of the plurality of filter sections includes an electrically conductive wire mesh medium configured to selectively receive electrical current to separately regenerate the separate filter section;

a plurality of dividers fluidly isolating one or more of the plurality of filters into filter divisions;

at least one inlet and at least one outlet individually associated with each filter division; and a valve assembly configured to selectively block a flow of exhaust through each of the inlets.

2. The particulate trap of claim 1, wherein the at least one inlet includes at least one inlet tube, and the at least one outlet includes at least one outlet tube.

3. The particulate trap of claim 1, wherein the at least one inlet includes a plurality of inlet tubes and the at least one outlet includes a plurality of outlet tubes.

4. The particulate trap of claim 1, wherein each of the plurality of filter sections has a substantially corrugated shape.

5. The particulate trap of claim 1, wherein the valve assembly includes a plurality of valve elements, each of the plurality of valve elements being configured to selectively block one of the at least one inlets.

6. The particulate trap of claim 1, further including a controller operable to selectively cause regeneration of at least one of the plurality of filter sections when a predetermined condition has been satisfied.

7. The particulate trap of claim 6, wherein the predetermined condition is a lapsed period of engine operation.

8. The particulate trap of claim 6, wherein the predetermined condition is a pressure differential measured across the filter divisions.

9. The particulate trap of claim 1, wherein each of the plurality of filters is substantially rectangular and a flow of exhaust enters a first side of the plurality of filters and exits a second side of the plurality of filters.

10. The particulate trap of claim 1, wherein all of the inlets receive exhaust from a common inlet chamber and all outlets flow exhaust to a common outlet chamber.

11. The particulate trap of claim 1, wherein an exhaust flow through each of the plurality of filters flows in one direction.

12. The particulate trap of claim 1, wherein each of the plurality of filters is independently replaceable.

13. A method of removing particulates from an exhaust flow, the method comprising:

flowing exhaust through a plurality of inlets, each inlet directing a portion of the exhaust flow to an associated filter division, each filter division being fluidly isolated from at least one other filter division and having at least one filter;

filtering particulates out of the exhaust flow with the at least one filter;

selectively blocking the exhaust flow through at least one filter division; and selectively applying electrical current to at least one of a plurality of filter sections of the at least one filter to separately regenerate the at least one filter section, each of the plurality of filter sections being separated from an adjacent filter section by an insulating member.

14. The method of claim 13, wherein the blocking of the exhaust flow and the selectively applying of current are performed when a predetermined condition has been satisfied.

15. An engine system, comprising:

an engine operable to produce an exhaust air flow;

a particulate trap operatively connected to the engine and configured to receive the exhaust air flow, the particulate trap including:

a housing;

a plurality of filters disposed within the housing, wherein each of the plurality of filters includes a plurality of filter sections separated from an adjacent filter section by at least one insulating member, wherein each of the plurality of filter sections includes an electrically conductive wire mesh medium configured to selectively receive electrical current to separately regenerate the separate filter section;

a plurality of dividers fluidly isolating one or more of the plurality of filters into filter divisions;

at least one inlet and at least one outlet individually associated with each filter division; and a valve assembly configured to selectively block a flow of exhaust through each of the inlets.

16. The engine system of claim 15, wherein the air distributor includes a plurality of valve elements, each of the plurality of valve elements being configured to selectively block one of the at least one inlets.

17. The engine system of claim 15, further including a controller operable to selectively cause regeneration of at least one of the plurality of filter sections when a predetermined condition has been satisfied.

18. The engine system of claim 17, wherein each of the plurality of filters is independently replaceable.

19. A particulate trap, comprising:

a housing;

a plurality of filters disposed within the housing, wherein each of the plurality of filters includes a plurality of filter sections separated from an adjacent filter section by an insulating member and each of the plurality of filter sections has a substantially corrugated shape, wherein each of the plurality of filter sections includes an electrically conductive wire mesh medium configured to selectively receive electrical current to separately regenerate the separate filter section;

a plurality of dividers fluidly isolating one or more of the plurality of filters into filter divisions;

at least one inlet and at least one outlet individually associated with each filter division; and a valve assembly configured to selectively block a flow of exhaust through each of the inlets.

20. The particulate trap of claim 19, wherein the at least one inlet includes at least one inlet tube, and the at least one outlet includes at least one outlet tube.

21. The particulate trap of claim 19, wherein the at least one inlet includes a plurality of inlet tubes and the at least one outlet includes a plurality of outlet tubes.

22. The particulate trap of claim 19, wherein the valve assembly includes a plurality of valve elements, each of the plurality of valve elements being configured to selectively block one of the at least one inlets.

23. The particulate trap of claim 19, further including a controller operable to selectively cause regeneration of at least one of the plurality of filter sections when a predetermined condition has been satisfied.

24. The particulate trap of claim 23, wherein the predetermined condition is a lapsed period of engine operation.

25. The particulate trap of claim 24, wherein the predetermined condition is a pressure differential measured across the filter divisions.

26. The particulate trap of claim 19, wherein each of the plurality of filters is substantially rectangular and a flow of exhaust enters a first side of the plurality of filters and exits a second side of the plurality of filters.

27. The particulate trap of claim 19, wherein all of the inlets receive exhaust from a common inlet chamber and all outlets flow exhaust to a common outlet chamber.

28. The particulate trap of claim 19, wherein an exhaust flow through each of the plurality of filters flows in one direction.

29. The particulate trap of claim 19, wherein each of the plurality of filters is independently replaceable.

* * * * *

UNITED STATES PATENT AND TRADEMARK OFFICE

CERTIFICATE OF CORRECTION

PATENT NO. : 7,185,489 B2
APPLICATION NO. : 10/743753
DATED : March 6, 2007
INVENTOR(S) : Owen C. Kolstad et al.

It is certified that error appears in the above-identified patent and that said Letters Patent is hereby corrected as shown below:

In the claims:

In Column 6, Line 30, in Claim 18, delete "17" and insert -- 15 --.

Signed and Sealed this

Twenty-second Day of July, 2008

JON W. DUDAS
*Director of the United States Patent and Trademark Office*